US007704111B2

(12) United States Patent
Ito et al.

(10) Patent No.: US 7,704,111 B2
(45) Date of Patent: Apr. 27, 2010

(54) EXHAUST SYSTEM OF OUTBOARD MOTOR

(75) Inventors: Jun Ito, Hamamatsu (JP); Hidehiko Yoshioka, Hamamatsu (JP); Takayuki Naoshima, Hamamatsu (JP); Fumikazu Kimata, Hamamatsu (JP); Tetsushi Achiwa, Kosai (JP); Hiromichi Takewaki, Hamamatsu (JP)

(73) Assignee: Suzuki Kabushiki Kaisha, Hamamatsu-Shi, Shizuoka-Ken (JP)

( * ) Notice: Subject to any disclaimer, the term of this patent is extended or adjusted under 35 U.S.C. 154(b) by 3 days.

(21) Appl. No.: 11/966,699

(22) Filed: Dec. 28, 2007

(65) Prior Publication Data

US 2008/0166935 A1 Jul. 10, 2008

(30) Foreign Application Priority Data

Jan. 9, 2007 (JP) ..... 2007-001464

(51) Int. Cl.

| | |
|---|---|
| ***B63H 21/00*** | (2006.01) |
| *B63H 21/10* | (2006.01) |
| *B63H 21/38* | (2006.01) |
| *B63H 21/34* | (2006.01) |
| *F01N 3/04* | (2006.01) |
| *F01N 3/38* | (2006.01) |
| *F01N 13/00* | (2010.01) |
| *B63H 21/32* | (2006.01) |
| *F01N 1/08* | (2006.01) |

(52) U.S. Cl. ..... 440/89 R; 440/88 R; 440/89 G; 440/89 H; 440/89 J

(58) Field of Classification Search ..... 440/88 R, 440/89 R, 89 G, 89 H, 89 J
See application file for complete search history.

(56) References Cited

U.S. PATENT DOCUMENTS

| | | | | |
|---|---|---|---|---|
| 5,916,135 | A * | 6/1999 | Yoshida et al. | 60/302 |
| 6,884,133 | B2 * | 4/2005 | Ishii | 440/89 H |
| 2002/0132730 | A1 * | 9/2002 | Hwang et al. | 502/212 |

FOREIGN PATENT DOCUMENTS

| | | |
|---|---|---|
| JP | 11-227693 | 8/1999 |
| JP | 2000-356123 | 12/2000 |
| JP | 31-80118 B2 | 6/2001 |

* cited by examiner

*Primary Examiner*—Daniel V Venne
(74) *Attorney, Agent, or Firm*—Barnes & Thornburg LLP

(57) ABSTRACT

An outboard motor includes a multi-cylinder engine which includes cylinders longitudinally oriented and vertically paralleled in a cylinder block, a cylinder head arranged at a rearward position of the cylinder blocks, and a crankcase arranged at a forward position of the cylinder block, the cylinder head having an outlet of an exhaust port at one side thereof. An exhaust system for the outboard motor includes an exhaust manifold which communicates the outlet of the exhaust port with an exhaust outlet opening, the exhaust manifold including a first exhaust gas passage extending in a vertical direction for gathering exhaust gas discharged from the outlet of each exhaust port and a second exhaust gas passage extending in a vertical direction adjacently to the first exhaust gas passage, and a catalyst unit is provided on the way of the second exhaust gas passage.

3 Claims, 9 Drawing Sheets

・WHEN ENGINE AND EXHAUST MANIFOLD ARE COOLED

·WHEN ENGINE IS COOLED AND EXHAUST MANIFOLD IS WARMED UP

・WHEN ENGINE AND EXHAUST MANIFOLD ARE WARMED UP

EXHAUST SYSTEM OF OUTBOARD MOTOR

CROSS-REFERENCE TO RELATED APPLICATIONS

This application is a U.S. Application based upon and claiming the benefit of priority to Japanese Patent Application Japan 2007-001464 filed on Jan. 9, 2007, the contents of which are incorporated herein by reference.

BACKGROUND OF THE INVENTION

1. Field of the Invention

The present invention relates to an exhaust system for an outboard motor.

2. Related Art

An internal combustion engines such as gasoline engine discharges an exhaust gas containing harmful components such as carbon monoxide (CO), hydrocarbon (HC), nitrogen oxide (NOx). An exhaust gas purifying device for rendering such harmful components harmless is generally classified into two types of devices based on their concepts.

An exhaust gas purifying device of one of these types is a device which induces complete combustion of fuel in a combustion chamber of an engine for preventing generation of harmful components. An exhaust gas purifying device of the other type is device which renders the exhaust gas discharged from a combustion chamber of an engine harmless before the exhaust gas is discharged to air, even if the exhaust gas contains harmful components.

As a system for purifying the exhaust gas of the latter type, there is provided a purifying device in which a catalyst containing, for example, platinum, rhodium and palladium is provided in an exhaust system in a manner such that the catalyst is exposed to the exhaust gas discharged from the combustion chamber of the so as to cause a chemical reaction therebetween for promoting oxidation and reduction of the exhaust gas for changing the harmful components into carbon dioxide ($CO_2$), water ($H_2O$), nitrogen ($N_2$) and the like to render them harmless.

As a catalyst device for an outboard motor, there is provided a device in which the outboard motor includes an exhaust outlet portion in a side surface of an upper portion of an engine, an exhaust gas passage in a lower portion of the engine, a spacer plate secured to cover the exhaust outlet portion and the exhaust gas passage, and a cover mounted to the spacer plate.

Another exhaust gas passage is formed between the spacer plate and the cover, and a catalyst is arranged in this exhaust gas passage.

Further, there is also provided a device in which the outboard motor includes an exhaust gas gathering member secured to a side surface of an upper portion of an engine for gathering exhaust gas discharged from an exhaust port, and a horizontal exhaust pipe and a vertical exhaust pipe which are coupled to the exhaust gas gathering member, and a catalyst is arranged in both the exhaust pipes (refer to Japanese Unexamined Patent Application Publication No. 2000-356123 (Patent Publication 1), for example).

Furthermore, there is also provided a catalyst device for an outboard motor in which an engine of the outboard motor includes exhaust gas passages which are paralleled with one another and are communicated to plural cylinder portions, an exhaust gas gathering portion which is communicated to the exhaust gas passages at the side of the exhaust gas passages opposite from a space, and a catalyst extending from the upper exhaust gas passage to the lower exhaust gas passage, in the exhaust gas gathering portion (refer to Japanese Patent No. 3180118 (Patent Publication 2), for example).

However, the structure which employs the spacer plate requires ensuring of a flat surface for arranging the plate, which causes a catalyst to be arranged far from the engine, resulting in an increasing of the size of the entire outboard motor.

Further, the structure which places plural catalysts in the plural exhaust pipes in different directions requires a complicated structure for holding the catalysts in the exhaust gas gathering member.

Furthermore, the structure which provides a catalyst extending from the upper exhaust gas passage to the lower exhaust gas passage requires a carrier having a cross-sectional shape different from the cross-sectional shapes (round shapes, elliptical shapes and oval shapes) of common carries (base members for catalysts) made of ceramics and metals. Therefore, it is difficult to manufacture such a carrier.

SUMMARY OF THE INVENTION

The present invention was made in view of the aforementioned circumstances and is directed to provide an exhaust system for an outboard motor which has improved exhaust gas purifying performance and has a compact size.

According to an aspect of the present invention, there is provided an exhaust system for an outboard motor which includes a multi-cylinder engine in which cylinders are arranged in a cylinder block in a longitudinally oriented and vertically paralleled fashion, a cylinder head is arranged at a rearward position of the cylinder block, and a crankcase is arranged at a forward position of the cylinder block) the cylinder head having an outlet of an exhaust port at one side thereof, and the exhaust system for the outboard motor includes: an exhaust manifold which communicates the outlet of the exhaust port with an exhaust outlet opening, the exhaust manifold including a first exhaust gas passage extending in a vertical direction for gathering exhaust gas discharged from the outlet of each exhaust port and a second exhaust gas passage extending in a vertical direction adjacently to the first exhaust gas passage; and a catalyst unit provided on a way of the second exhaust gas passage.

In a preferred embodiment of the above aspect, the first exhaust gas passage and the second exhaust gas passage may be communicated with each other through a communication passage at a central portion of the first exhaust gas passage in the vertical direction, and the second exhaust gas passage is provided below the communication passage.

The exhaust manifold may be constructed so as to be split vertically, and a split surface of the exhaust manifold is formed on the way of the second exhaust gas passage below the lower end portion of the first exhaust gas passage.

The second exhaust gas passage may be formed to have an oval or elliptical cross-sectional shape, and at least a portion of the second exhaust gas passage is arranged inward the line connecting the cylinder head and an end portion of the crankcase in the width direction, as viewed in a plane.

It may be desired that a pressure relief valve is provided for a water jacket formed in the exhaust manifold on an upstream side of the catalyst unit, and a thermostat is provided for the water jacket at a downstream side of the catalyst unit.

The catalyst unit may be provided with a catalyst using a metal or ceramic honeycomb as a supporter, and the catalyst may be wound up by an insulating material.

According to the present invention of the characters mentioned above, it is possible to reduce the size of the engine in the width direction and also possible to improve the exhaust gas purifying performance.

DESCRIPTION OF THE PREFERRED EMBODIMENTS

Hereunder, preferred embodiments of the present invention will be described with reference to the accompanying drawings. Further, it is to be noted that terms "upper", "lower", "right', "left" and like terms are used herein with reference to the illustration of the accompanying drawings or in an actual installed or mounted state of an outboard motor.

Figure 1:
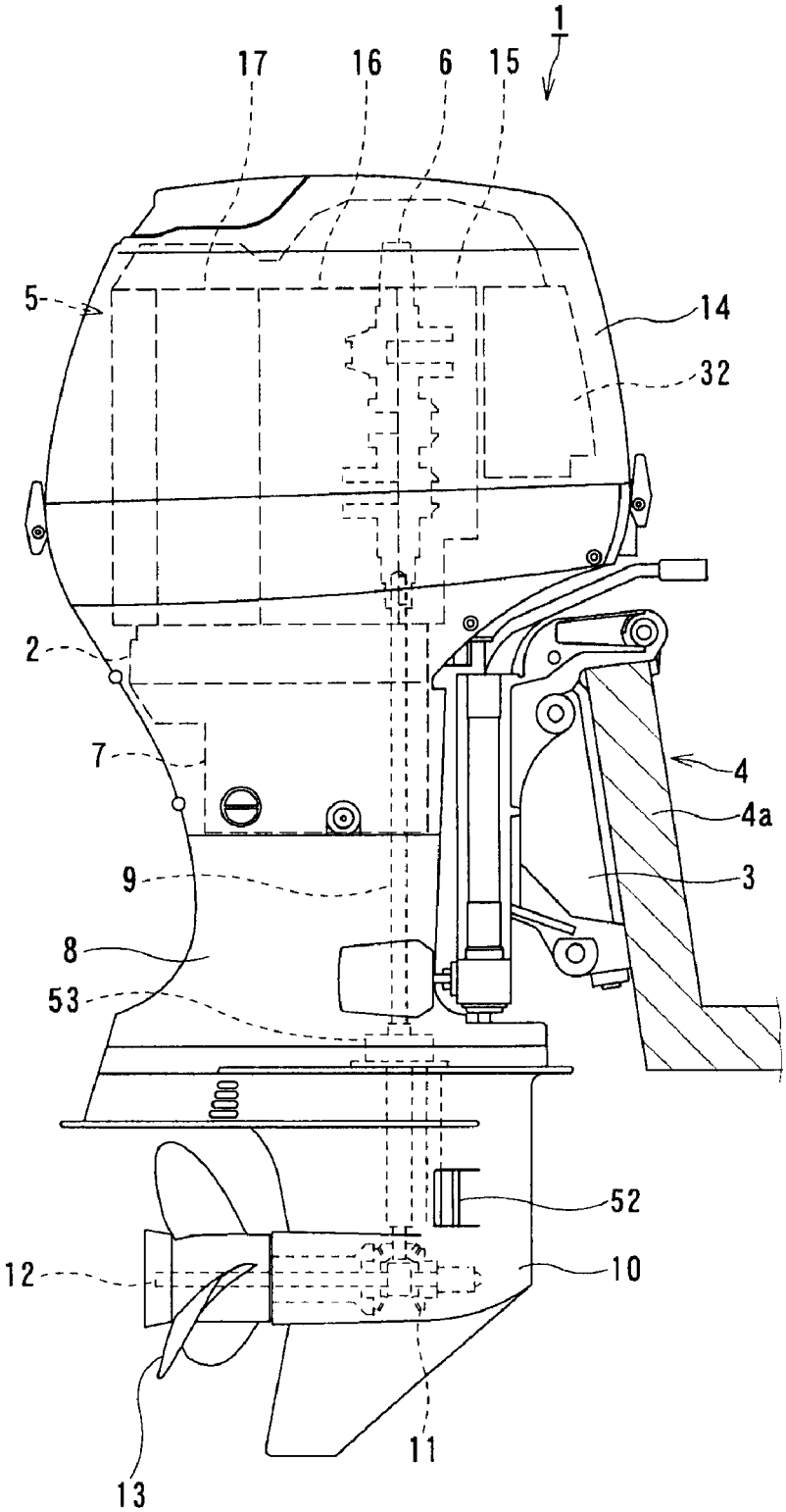
FIG. 1 is a right side view illustrating an embodiment of an exhaust system for an outboard motor according to the present invention.

With reference to FIG. 1, which is a right side view of an outboard motor to which the present invention is applied) an outboard motor 1 includes an engine holder 2 and is mounted to a transom 4*a* of a hull 4 through a bracket 3 which is mounted to the engine holder 2. Further, an engine 5 is installed to the upper portion of the engine holder 2.

In the engine 5, a crankshaft 6 is vertically provided so as to be directed substantially in the vertical direction. Further, a drive-shaft housing 8 is installed below the engine holder with an oil pan 7 interposed between the engine holder 2 and the drive shaft housing 8.

A drive shaft 9 coupled to the lower end of the crankshaft 6 is downwardly extended throughout the oil pan 7 and the drive-shaft housing 8 so as to drive a propeller 13 through a bevel gear 11 and a propeller shaft 12 arranged in a gear case 10 provided on the upper portion of the drive-shaft housing 8. The engine 5 is covered with an engine cover 14.

The engine 5 is, for example, a four-stroke-cycle multi-cylinder engine (four-cylinder engine in the present embodiment), in which a crankcase 15, a cylinder block 16 and a cylinder head 17 are arranged in the mentioned order from the front portion to the rear portion of the outboard motor 1.

Figure 2:
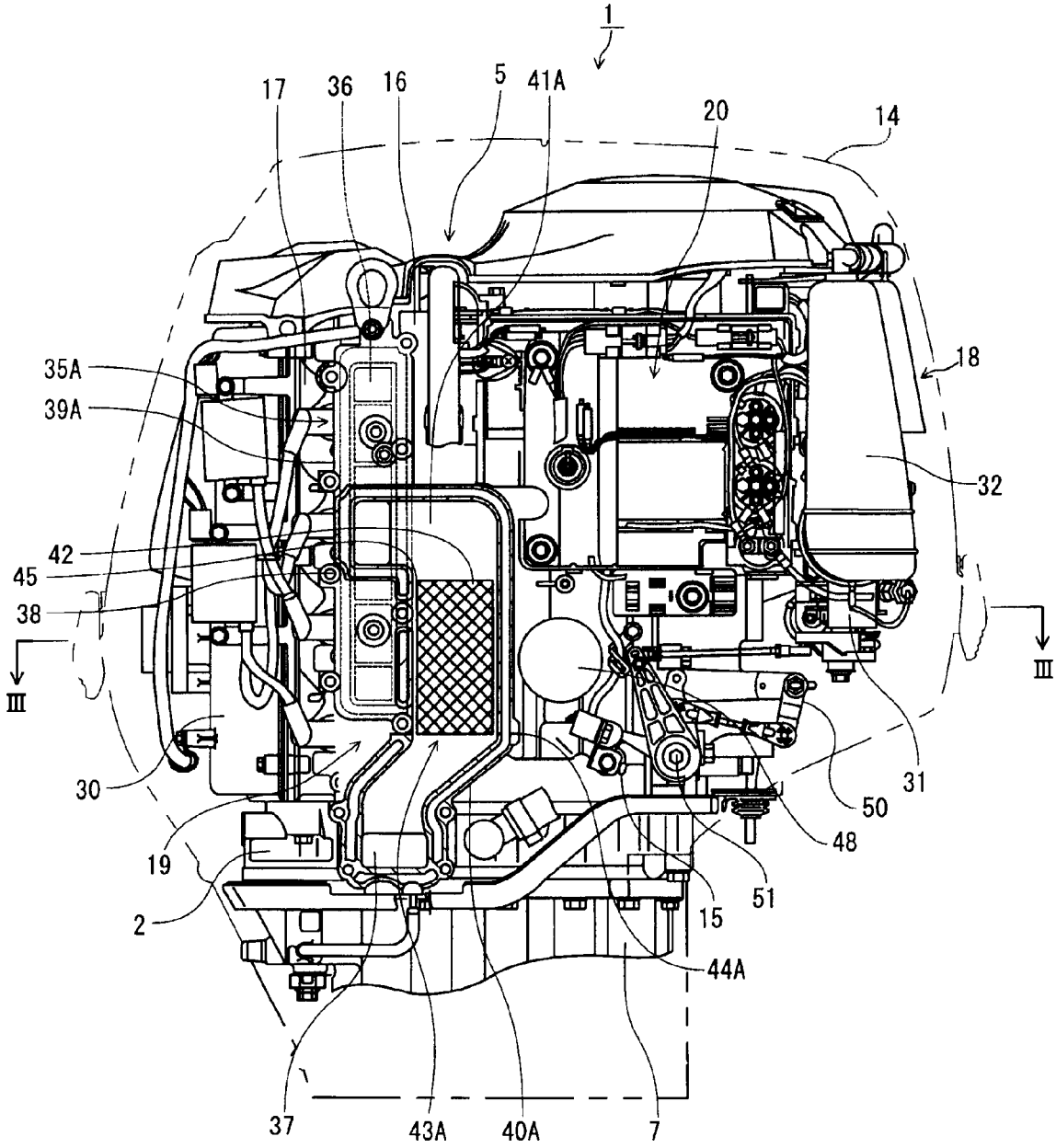
FIG. 2 is an enlarged schematic right side view illustrating an engine portion of an outboard motor according to a first embodiment of the present invention.
Figure 3:
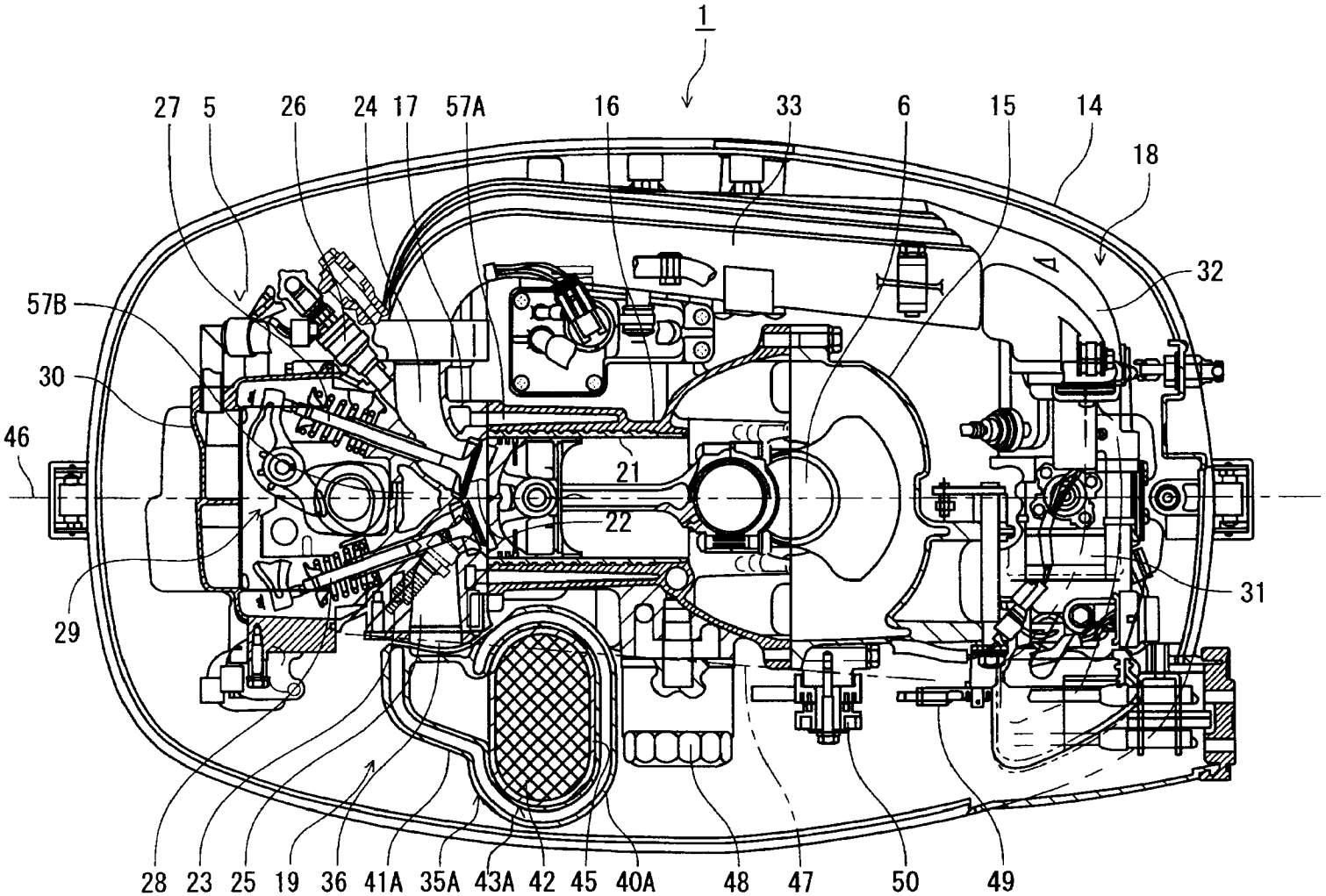
FIG. 3 is a cross-sectional view taken along the line III-III in FIG. 2.

FIG. 2 is an enlarged schematic right side view illustrating the portion of the engine 5 in the outboard motor 1 according to the first embodiment of the present invention, in which only the engine cover 14 is illustrated with an imaginary line, and FIG. 3 is a cross-sectional view taken along the line III-III in FIG. 2.

Figure 4:
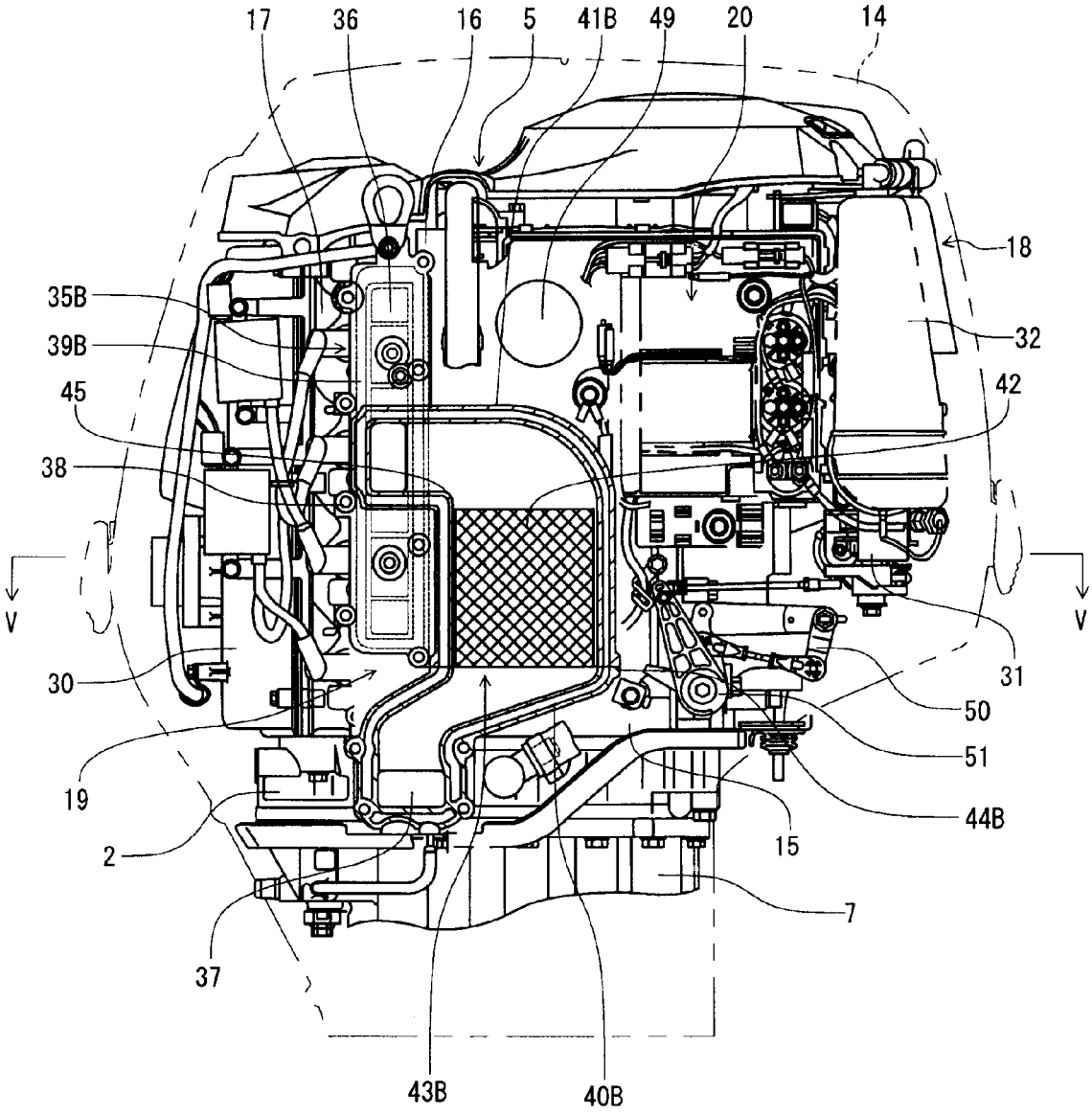
FIG. 4 is an enlarged schematic right side view illustrating an engine portion in an outboard motor according to a second embodiment of the present invention.
Figure 5:
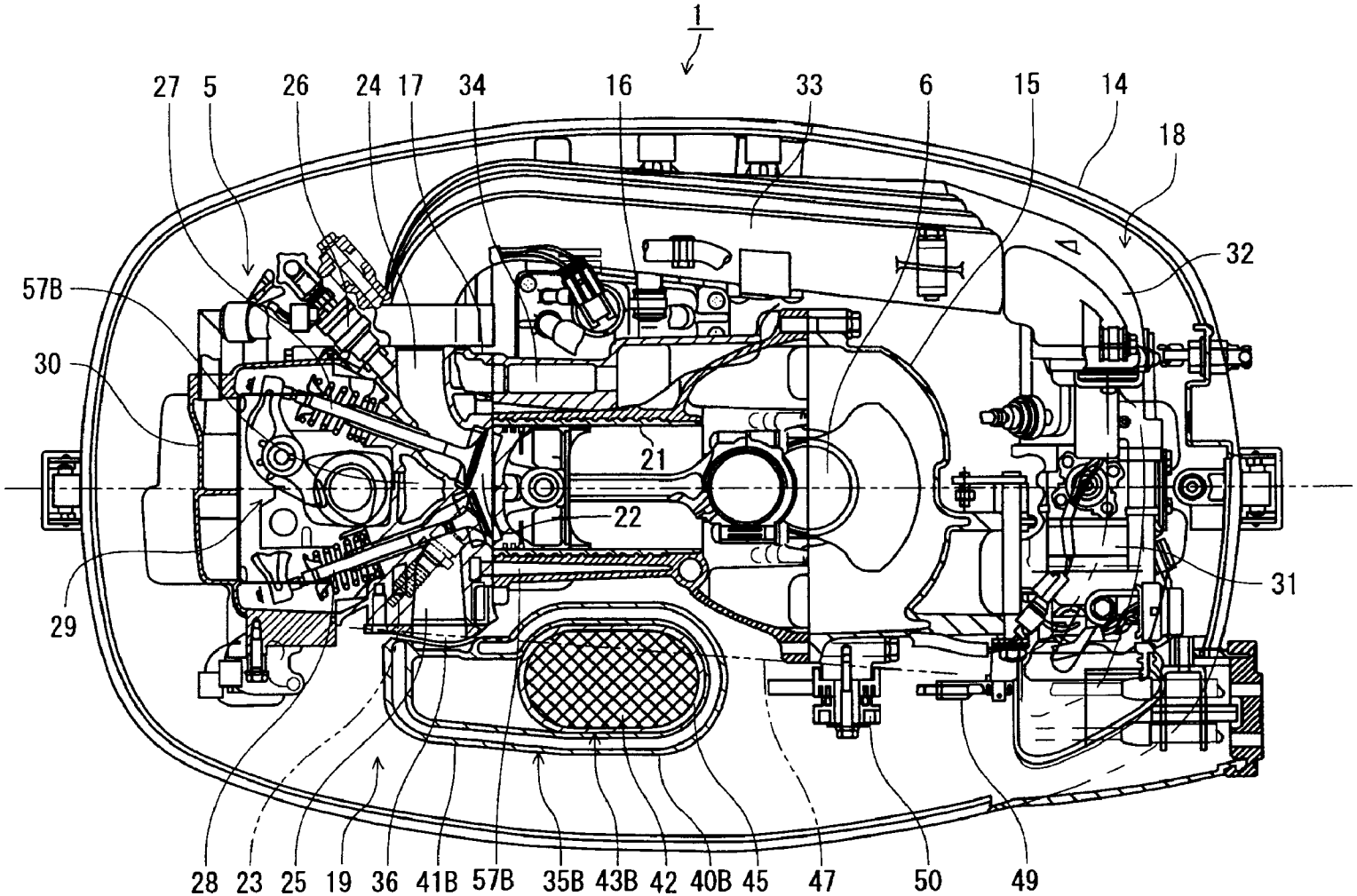
FIG. 5 is a cross-sectional view taken along the line V-V in FIG. 4.

FIG. 4 is an enlarged schematic right side view illustrating the portion of the engine 5 in the outboard motor 1 according to the second embodiment of the present invention, in which only the engine cover 14 is illustrated with an imaginary line, and FIG. 5 is a cross-sectional view taken along the line V-V in FIG. 4. Further, in both the embodiments) like reference numerals designate the same components.

As illustrated in FIGS. 2 to 5, an intake system 18, an exhaust system 19, electrical components 20 and the like are arranged around the engine 5. While the intake system 18 is arranged from the left of the engine 5 up to a portion in front of the engine 5, the exhaust system 19 is arranged at the right of the engine 5, and the electrical components 20 are arranged at the right of the engine 5 similarly to the exhaust system 19.

Although not illustrated in detail, a plurality of cylinders 21, which are four cylinders 21 in the present embodiment, are longitudinally oriented and vertically paralleled. Further, in the cylinder head 17, there is formed a combustion chamber 22 which matches with the cylinder 21, and an ignition plug 23 is attached from the outside.

Furthermore, in the cylinder head 17, there is formed an intake port 24 and an exhaust port 25 which are communicated to the combustion chamber 22. A fuel injector 26 is mounted to the cylinder head 17 from the outside thereof, the fuel injector 26 being adapted to inject fuel into the intake port 24.

In the cylinder head 17, there are also provided an intake valve 27 and an exhaust valve 27 for opening and closing the intake and exhaust ports 24 and 25, and there is also provided a valve train 29 for operating these valves 27 and 29. The valve train 29 arranged in the cylinder head 17 is covered with a head cover 30.

The intake system 18 includes a throttle body 31, a surge tank 32, and an intake manifold 33 extending from the surge tank 32 to each cylinder. The intake manifold 33 is arranged vertically along a side surface of the cylinder block 16 and communicates the intake port 24 of the cylinder which is formed in the cylinder head 17 with the inside of the serge tank 32.

Further, as illustrated in FIG. 5, a blow-by gas passage 34 is formed along a side surface of the engine 5 on the side of the intake system 18.

On the other hand, the exhaust system 19 has an exhaust manifold 35A (35B) separated from the engine 5. The exhaust manifold 35A (35B) is mounted so as to straddle side surfaces of the cylinder head 17 and the engine holder 2 and communicates an outlet 36 of the exhaust port formed at one side of the cylinder head 17 to an exhaust outlet opening 37 formed in the engine holder 2.

Furthermore, the exhaust manifold 35A (35B) is secured to the side surfaces of the cylinder head 17 and the engine holder 2 through bolts 38, for example. The exhaust manifold 35A (35B) includes a first exhaust gas passage 39A (39B) extending vertically for gathering exhaust gas discharged from the outlets 36 of each exhaust port, and also includes a second exhaust gas passage 40A (40B) extending vertically adjacently to the first exhaust gas passage 39A (39B).

At the center portion of the first exhaust gas passage 39A in the vertical direction, there is provided a communication passage 41A (41B) for communicating the first exhaust gas passage 39A (39B) to the second exhaust gas passage 40A (40B).

Furthermore, below the communication passage 41A (41B), there is provided the second exhaust gas passage 40A (40B). Further, a catalyst unit 43A (43B) including a catalyst 42 which employs, for example, a metal honeycomb as a carrier is disposed on the way of the second exhaust gas passage 40A (40B).

Furthermore, the curved portion of the exhaust manifold 35A (35B) has a curvature radius set to be larger, and the portion of the inner surface of the curved portion which directly contacts with the exhaust gas are formed to have a thickness greater than that of the other portion, though not illustrated in detail.

The exhaust manifold 35A (35B) is structured so as to be split upwardly and downwardly. A split surface 44A (44B) of the exhaust manifold 35A (35B) is formed on the way of the second exhaust gas passage 40A (40B) and below the lower end portion of the first exhaust gas passage 39A (39B), and the catalyst unit 43A (43B) is inserted thereinto upwardly from the split surface 44A (44B).

At this time, in order to prevent the catalyst 42 from coming into contact with the exhaust manifold 35A (35B) and, also, in order to prevent the catalyst 42 from being excessively cooled, the catalyst 42 is press-fitted in the direction of the exhaust gas flow with a mat-type heat insulation member 45 wound therearound.

The second exhaust gas passage 40A (40B) is formed to have an oval cross-sectional shape or an elliptical cross-sectional shape at its portion into which the catalyst unit 43A (43B) is inserted. In the exhaust manifold 35A illustrated in the first embodiment, the second exhaust gas passage 40A is formed to have a cross-sectional shape orthogonal to the axis 46 of the cylinder in the longitudinal direction.

Furthermore, in the exhaust manifold 35B illustrated in the second embodiment, the second exhaust gas passage 40B is formed to have a cross-sectional shape parallel to the axis 46 of the cylinder in the longitudinal direction. The catalyst 42 is formed to have a sufficient size in the radial direction.

At least a portion of the second exhaust gas passage 40A (40B) of the exhaust manifold 35A (35B), such as the portion for housing the catalyst unit 43A (43B), is arranged inward the line 47 connecting the cylinder head 17 to an end portion of the crankcase 15 in the width direction, namely more proximally to the center of the outboard motor 1, and also in the space between the center of the crankshaft 6 and the exhaust ports 25 in the forward and rearward directions as viewed in a plane.

Further, in the case where the longitudinal direction of the second exhaust gas passage 40A is orthogonal to the axis 46 of the cylinder as viewed in a plane in the engine 5 of the outboard motor 1 of the first embodiment, there is a relatively large clearance in the space in front of the second exhaust gas passage 40A. Accordingly, an oil filter 48 is arranged in this space, and a link mechanism 50 for a clutch device and a link mechanism 51 for the aforementioned throttle body 31, not shown, are also arranged at a forward position of the oil filter 48.

On the other hand, in the case where the longitudinal direction of the second exhaust gas passage 40B is parallel to the axis 46 of the cylinder as viewed in a plane in the engine 5 of the outboard motor 1 of the second embodiment, there is a smaller clearance in the space in front of the second exhaust gas passage 40B. Accordingly, only the aforementioned link mechanisms 50 and 51 are arranged in this space, and an oil filter 49 is arranged in a space having a relatively-large clearance above the second exhaust gas passage 40B.

Figure 6:
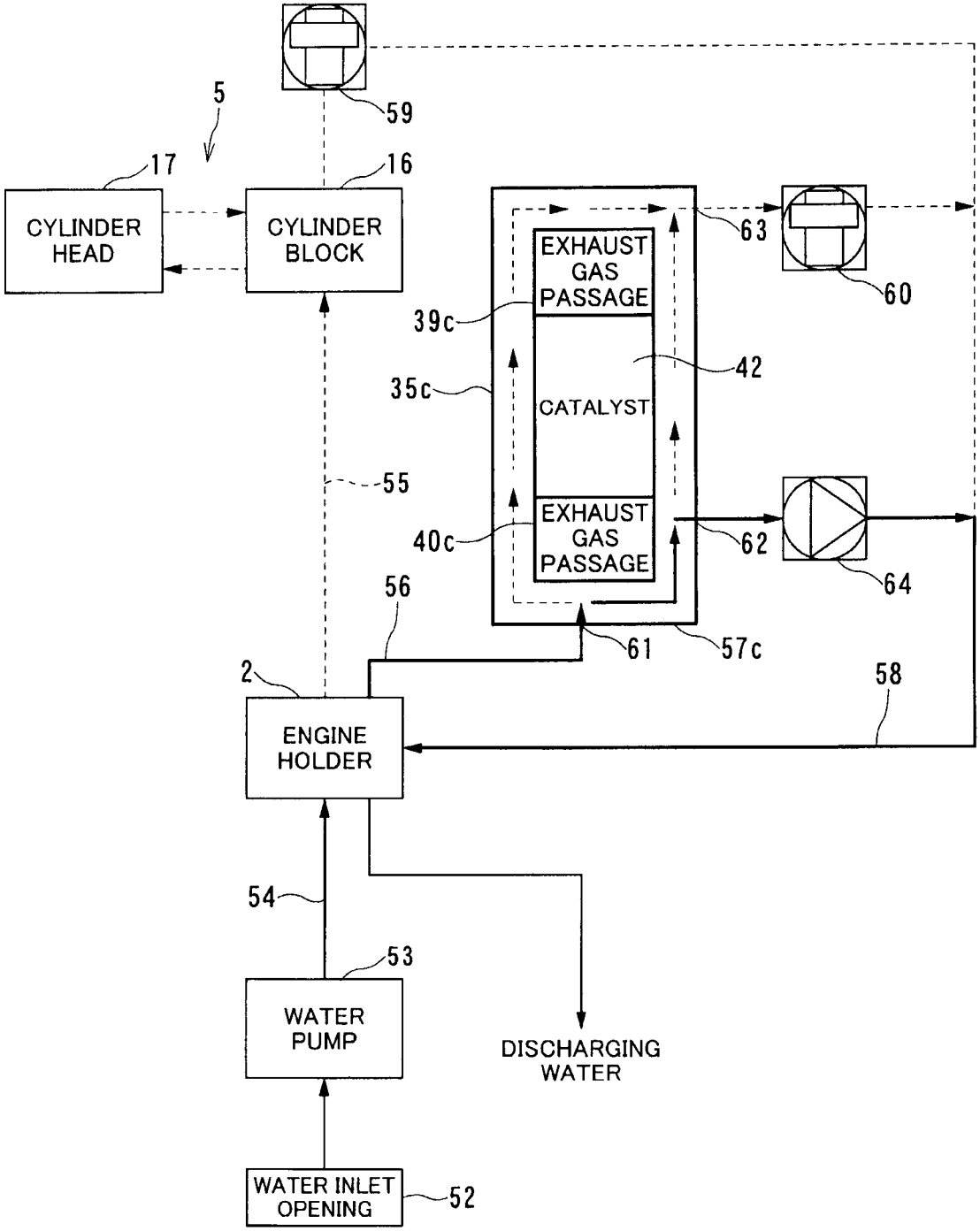
FIG. 6 is a flow-path diagram of an engine cooling system in a state that both the engine and an exhaust manifold are cooled.

Incidentally, the engine 5 in the outboard motor 1 is of a water-cooled type and, for example, seawater introduced through a water inlet opening 52 formed in the gear case 10 as shown in FIG. 1 is used as cooling water for cooling the engine 5. FIG. 6 is a flow-path diagram of the cooling system for the engine 5.

As illustrated in FIG. 1 and FIG. 6, cooling water is introduced through the water inlet opening 52 by the operation of a water pump 53 which is driven by the drive shaft 9, then is directed to the inside of the engine holder 2 through a cooling-water passage 54, and is directed to the inside of the engine 5 through a cooling-water passage 55 formed through the engine holder 2.

As illustrated in FIG. 3 and FIG. 5, a water jacket 57A is formed around the cylinder 21 in the cylinder block 16. A water jacket 57B is formed around the combustion chamber 22 in the cylinder head 17. Further, although not illustrated in detail, the cooling-water passage 55 extending from the engine holder 2 is connected to the water jackets 57A and 57B.

A cooling-water discharge passage 58 extends from the cylinder block 16 to the engine holder 2 so that the cooling water is discharged from the engine holder 2 to the outside of the outboard motor 1.

A thermostat 59 is provided on the way of the cooling-water discharge passage 58, and if the temperature of the cooling water in the water jackets 57A and 57B formed in the engine 5 indicates a temperature more than a predetermined temperature, the thermostat 59 is opened, which causes the cooling water to be discharged to the cooling-water discharge passage 58, thus maintaining the temperature of the cooling water in the water jackets 57A and 57B at a constant value.

FIG. 6 illustrates a state where the engine 5 is cooled and the thermostat 59 is closed. On the other hand, there is provided an exhaust cooling system separated from the cooling system for the engine 5 in the exhaust manifold 35A (35B).

Figure 7:
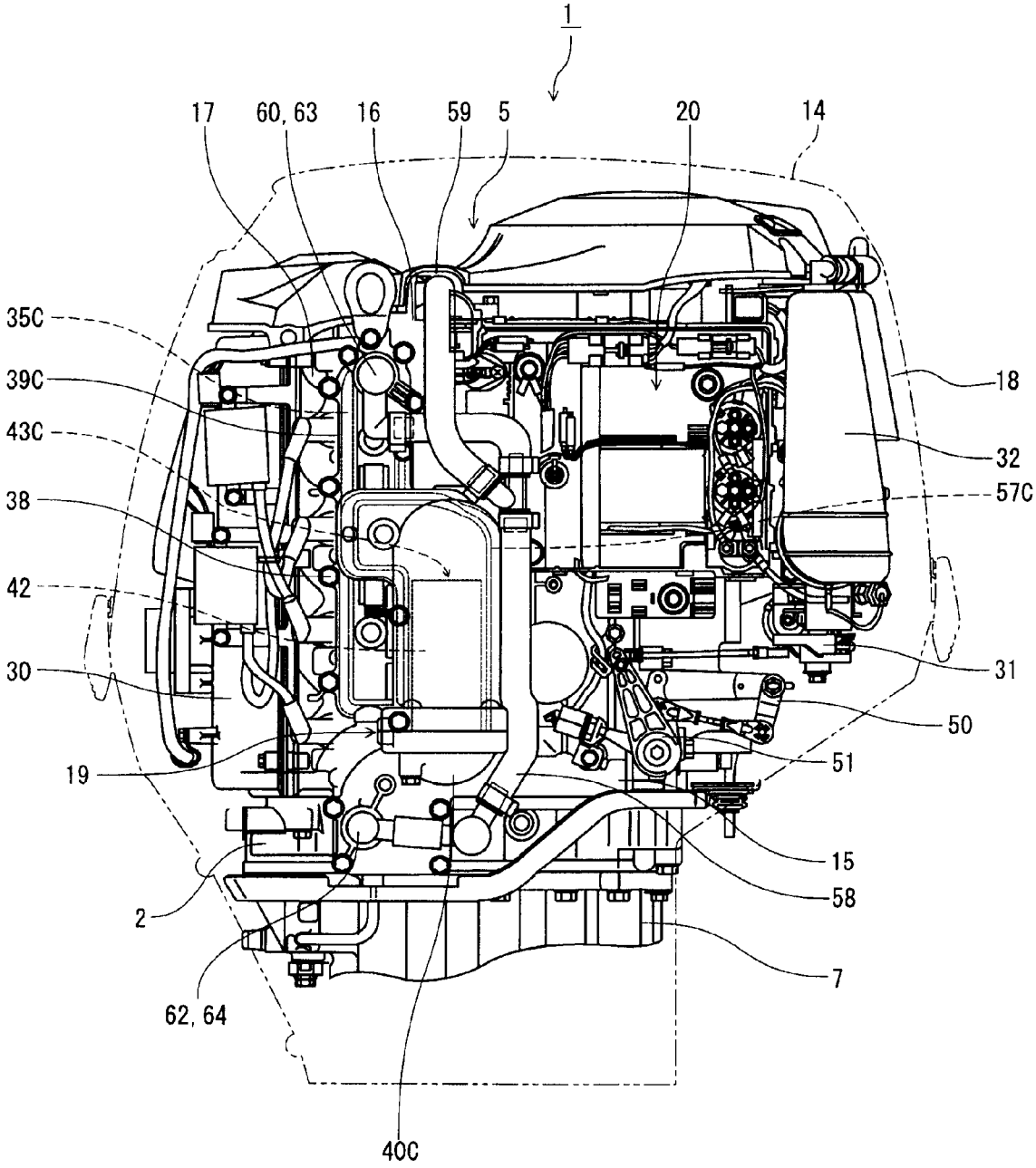
FIG. 7 is an enlarged schematic right side view illustrating an engine portion in an outboard motor according to a third embodiment of the present invention.

FIG. 7 is an enlarged schematic right side view illustrating the portion of the engine 5 of the outboard motor 1 according to a third embodiment of the present invention, illustrating an exhaust cooling system in detail. The same components as those in the first and second embodiments will be designated by the same reference characters.

As illustrated in FIG. 6 and FIG. 7, a water jacket 57C for cooling a first exhaust gas passage 39C and a second exhaust gas passage 40C is formed in an exhaust manifold 35C. For example, a cooling-water inlet 61 is formed at the lower end portion of the exhaust manifold 35C and is connected to a cooling-water passage 56 separated from the cooling system of the engine 5 which is formed in the engine holder 2.

A cooling-water outlet 62 is formed at a lower portion of the water jacket 57C formed in the exhaust manifold 35C (i.e., at a portion of the water jacket 57C upstream of a catalyst unit 43C). A pressure relief valve 64 is attached to the cooling-water outlet 62, and if the pressure of the cooling water in the water jacket 57C becomes higher than a predetermined pressure, the pressure relief valve 64 is opened, which causes the cooling water to be discharged to the cooling-water discharge passage 58, thus maintaining the pressure of the cooling water in the water jacket 57C at a constant value.

Another cooling-water outlet 63 is also formed at an upper portion of the water jacket 57C formed in the exhaust manifold 35C (i.e., at a portion of the water jacket 57C downstream of the catalyst unit 43C).

A thermostat 60 is attached to the cooling-water outlet 63, and if the temperature of the cooling water in the water jacket 57C becomes higher than a predetermined temperature, the thermostat 60 is opened, which causes the cooling water to be discharged to the cooling-water discharge passage 58, thus maintaining the temperature of the cooling water in the water jacket 57C at a constant value.

Figure 8:
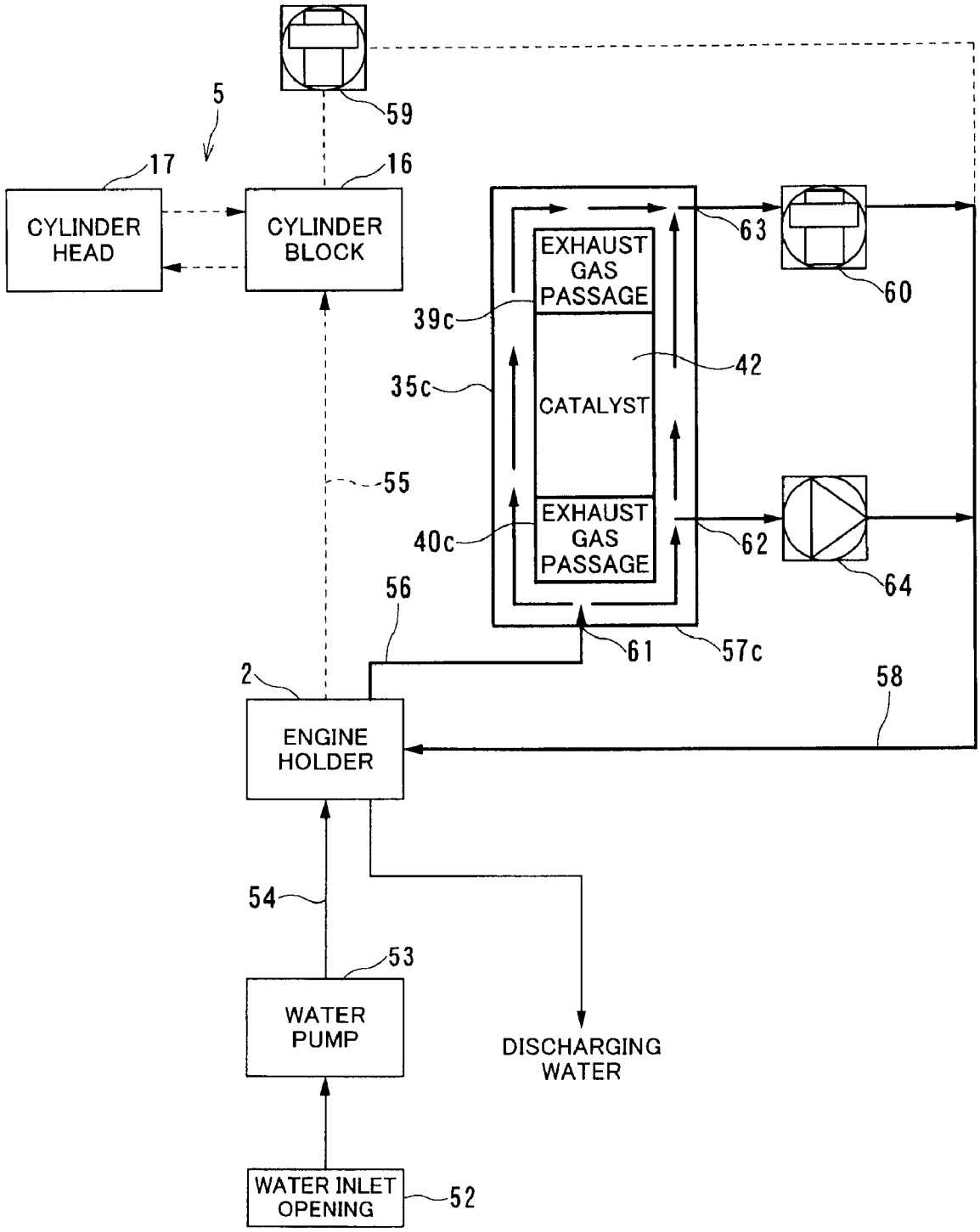
FIG. 8 is a flow-path diagram of the engine cooling system in a state that the engine is cooled while the exhaust manifold is warmed up.
Figure 9:
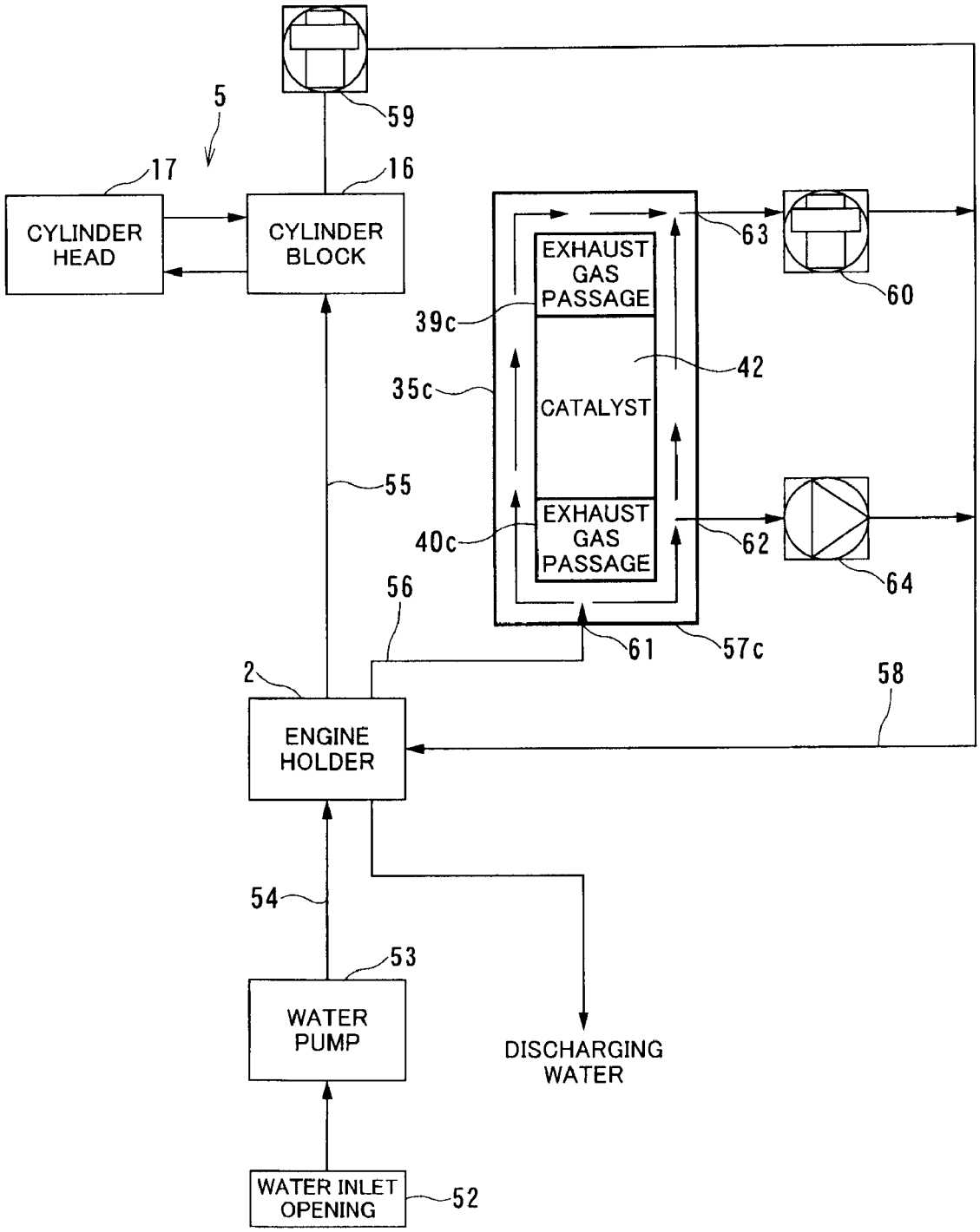
FIG. 9 is a flow-path diagram of the engine cooling system in a state that both the engine and the exhaust manifold are warmed up.

FIG. 6 illustrates a state where the engine 5 is cooled and the thermostat 60 is closed, FIG. 8 is a flow-path diagram of the cooling system for the engine 5, illustrating a state where the engine 5 is cooled and the exhaust manifold 35C is warmed up. FIG. 9 is a flow-path diagram of the cooling system for the engine 5, illustrating a state where both the engine 5 and the exhaust manifold 35C are warmed up.

Hereunder, operations of the present embodiment will be described.

The exhaust manifold 35A (35B) are provided for communicating the outlet 36 of the exhaust port in the cylinder head 17 to the exhaust outlet opening 37 formed in the engine holder 2.

The exhaust manifold 35A (35B) includes the first exhaust gas passage 39A (39B) extending in the vertical direction for gathering exhaust gas discharged from the outlets 36 of each exhaust port and also includes the second exhaust gas passage 40A (40B) extending in the vertical direction adjacently to the first exhaust gas passage 39A (39B). The catalyst unit 43A (43B) is provided on the way of the second exhaust gas passage 40A (40B). Accordingly, compactness of the size of the engine 5 in the width direction can be achieved.

Further, the communication passage 41A (41B) for communicating the first exhaust gas passage 39A (39B) to the second exhaust gas passage 40A (40B) is provided at the center portion of the first exhaust gas passage 39A (39B) in the vertical direction, and the second exhaust gas passage 40A (40B) is provided below the communication passage 41A (41B), thereby forming a space above the second exhaust gas passage 40A (40B), and enabling auxiliary equipment for the engine 5 to be arranged. In addition, compactness of the size of the engine 5 in the width direction can be achieved.

Furthermore, the exhaust manifold 35A (35B) is structured so as to be split upwardly and downwardly, and the split surface 44A (44B) of the exhaust manifold 35A (35B) is formed on the way of the second exhaust gas passage 40A (40B) below the lower end portion of the first exhaust gas passage 39A (39B). Thus, the catalyst 42 can be easily attached or detached, and the exhaust manifold 35A (35B) can be simply structured with a compact size.

Further, the second exhaust gas passage 40A (40B) is formed to have an oval or elliptical cross-sectional shape at a portion into which the catalyst unit 43A (43B) is inserted, and at least a portion of the second exhaust gas passage 40A (40B) is arranged inward the line 47 connecting the cylinder head 17 to an end portion of the crankcase 15 in the width direction as viewed in a plane, thereby effectively utilizing a dead space and reducing the size of the engine 5 in the width direction.

Therefore, a cross-sectional area of the catalyst 42 can be sufficiently ensured, and the exhaust gas purifying performance can be improved.

In addition, the pressure relief valve 64 is provided in the water jacket 57C formed in the exhaust manifold 35C at a portion upstream of the catalyst unit 43C, and the thermostat 60 is provided in the water jacket 57C at a portion downstream of the catalyst unit 43C.

Accordingly, the cooling water does not flow around the catalyst unit 43C even when the engine 5 is cooled. Thus, the activation of the catalyst 42 is promoted and the temperature of the catalyst 42 can be rapidly set to a proper value. This results in the improvement of the exhaust gas purifying performance.

Furthermore, the catalyst 42 is press-fitted to the second exhaust gas passage 40 with the mat-type heat insulation member 45 wound therearound, and accordingly, the catalyst 42 is prevented from being excessively cooled, thereby maintaining the temperature of the catalyst 42 at a high temperature.

Furthermore, even if the catalyst used herein is made of, for example, a metal honeycomb, the catalyst 42 is separated from the second exhaust gas passage 40C, and the possibility of the occurrence of electrolytic corrosion can be eliminated even though the water jacket 57C is provided in the exhaust manifold 35C.

An excellent sealing property between the catalyst 42 and the second exhaust gas passage 40C can be ensured without welding and the like, and also the transfer of vibrations to the catalyst 42 is suppressed, thereby improving the vibration resistance even if the catalyst used herein is made of, for example, a ceramic honeycomb.

Moreover, since the catalyst unit 43A, 43B and 43C can be made to be compact, it is possible to provide the catalyst 42 having a sufficient size in the radial direction. The temperature of the center portion of the catalyst unit can be maintained at a high temperature, even at a state where the engine is cooled and the ambient temperature is lowered immediately after the engine is started. This can improve the exhaust gas purifying performance.

In addition, the back pressure is suppressed from rising, thereby preventing the reduction of the engine output.

Still furthermore, there is provided the exhaust cooling system separated from the cooling system for the engine 5 in the exhaust manifold 35C, and the cooling water exists around the catalyst 42 during the operation of the engine 5. Accordingly, it is possible to thermally protect the periphery of the exhaust manifold 35C and reduce noises.

The temperature of the exhaust manifold 35A (35B, 35C) becomes significantly high during the reaction of the catalyst 42. Accordingly, it is not preferable that the temperature distribution therein becomes uneven, since the degree of the expansion of the exhaust manifold 35A (35B, 35C) becomes uneven.

However, the curved portions of the exhaust manifold 35A (35B, 35C) have curvature radiuses set to be larger, and the inner surface of the curved portion which is exposed to the exhaust gas has thickness set to be larger than that of the other portion, and therefore, the local large stresses in the exhaust manifold 35A (35B, 35C) can be prevented from occurring.

It is to be noted that the present invention is not limited to the described embodiments and many other changes and modifications may be made without departing from the scopes of the appended claims.

What is claimed is:

1. An exhaust system of an outboard motor which includes a multi-cylinder engine in which cylinders are disposed in a cylinder block in a longitudinally oriented and vertically parallel manner, a cylinder head is arranged at a rearward position of the cylinder block, and a crankcase is arranged at a position in front of the cylinder block, the cylinder head having an outlet of an exhaust port at one side thereof, the exhaust system for the outboard motor comprising:

an exhaust manifold which communicates the outlet of the exhaust port with an exhaust discharge opening, the exhaust manifold including a first exhaust gas passage extending in a vertical direction for gathering exhaust discharged from the outlet of each exhaust port and a second exhaust gas passage extending in a vertical direction adjacently to the first exhaust passage; and a catalyst unit provided on a way of the second exhaust passage, wherein the first exhaust gas passage and the second exhaust gas passage are communicated with each other through a communication passage provided at a central portion of the first exhaust passage in the vertical direction, and the second exhaust gas passage is arranged below the communication passage.

2. An exhaust system of an outboard motor which includes a multi-cylinder engine in which cylinders are disposed in a cylinder block in a longitudinally oriented and vertically parallel manner, a cylinder head is arranged at a rearward position of the cylinder block, and a crankcase is arranged at a position in front of the cylinder block, the cylinder head having an outlet of an exhaust port at one side thereof, the exhaust system for the outboard motor comprising:

an exhaust manifold which communicates the outlet of the exhaust port with an exhaust discharge opening, the exhaust manifold including a first exhaust gas passage extending in a vertical direction for gathering exhaust gas discharged from the outlet of each exhaust port and a second exhaust gas passage extending in a vertical direction adjacently to the first exhaust gas passage; and a catalyst unit provided on a way of the second exhaust gas passage, wherein the second exhaust gas passage is formed to have an oval or elliptical cross-sectional shape, and at least a portion of the second exhaust gas passage is arranged inboard of a straight line connecting a side of the cylinder head to an end portion of the crankcase as viewed in cross-section in a horizontal plane in the width direction.

3. An exhaust system of an outboard motor which includes a multi-cylinder engine in which cylinders are disposed in a cylinder block in a longitudinally oriented and vertically parallel manner, a cylinder head is arranged at a rearward position of the cylinder block, and a crankcase is arranged at a position in front of the cylinder block, the cylinder head having an outlet of an exhaust port at one side thereof, the exhaust system for the outboard motor comprising:

an exhaust manifold which communicates the outlet of the exhaust port with an exhaust discharge opening, the exhaust manifold including a first exhaust gas passage extending in a vertical direction for gathering exhaust gas discharged from the outlet of each exhaust port and a second exhaust gas passage extending in a vertical direction adjacently to the first exhaust gas passage; and a catalyst unit provided on a way of the second exhaust gas passage, wherein a pressure relief valve is mounted to a water jacket formed in the exhaust manifold on an upstream side of the catalyst unit, and a thermostat is disposed on the water jacket on a downstream side of the catalyst unit.

* * * * *